US009737782B1

(12) United States Patent
Shi et al.

(10) Patent No.: US 9,737,782 B1
(45) Date of Patent: Aug. 22, 2017

(54) RACKET-FREE TENNIS TRAINING DEVICE

(71) Applicant: Shaoxing Kaijian Technology Co., Ltd., Shaoxing (CN)

(72) Inventors: Songquan Shi, Shaoxing (CN); Fan Yang, Baoding (CN); Dong Xuan, Columbus, OH (US)

(73) Assignee: SHAOXING KAIJIAN TECHNOLOGY CO., LTD., Shaoxing, Zhejiang (CN)

( * ) Notice: Subject to any disclaimer, the term of this patent is extended or adjusted under 35 U.S.C. 154(b) by 0 days.

(21) Appl. No.: 15/229,138

(22) Filed: Aug. 5, 2016

(30) Foreign Application Priority Data

Feb. 17, 2016 (CN) ..... 2016 1 0088416

(51) Int. Cl.
*F41B 4/00* (2006.01)
*A63B 69/40* (2006.01)
*A63B 69/38* (2006.01)

(52) U.S. Cl.
CPC ..... *A63B 69/406* (2013.01); *A63B 69/38* (2013.01); *A63B 2208/0204* (2013.01)

(58) Field of Classification Search
CPC ..... A63B 69/406; F41B 4/00
See application file for complete search history.

(56) References Cited

U.S. PATENT DOCUMENTS 4,323,048 A * 4/1982 Saito ..... A63B 69/406 124/78
4,442,823 A * 4/1984 Floyd ..... A63B 69/406 124/41.1
5,125,653 A * 6/1992 Kovacs ..... A63B 69/406 124/78
5,417,196 A * 5/1995 Morrison ..... A63B 69/40 124/6
5,464,208 A * 11/1995 Pierce ..... A63B 69/406 124/78
5,776,018 A * 7/1998 Simpson ..... A63B 24/0021 473/433
7,100,594 B2 * 9/2006 Boehner ..... A63B 69/406 124/78
8,123,634 B1 * 2/2012 Lovett ..... A63B 63/083 473/433

* cited by examiner

*Primary Examiner* — John Ricci
(74) *Attorney, Agent, or Firm* — Leong C. Lei

(57) ABSTRACT

A racket-free tennis training device includes a maneuverable platform on which an elevation mechanism is mounted. A ball receiving and shooting mechanism is mounted on the elevation mechanism. The ball receiving and shooting mechanism includes a ball receiving mechanism, a ball management mechanism, and a ball shooting mechanism. The ball receiving mechanism includes a ball receptacle. The ball management mechanism includes a ball collection barrel and an advancing mechanism. The above arrangement allows for correctly receiving a tennis ball from an opponent site and then serving a ball to the opponent site to simulate an actual tennis game.

9 Claims, 7 Drawing Sheets

RACKET-FREE TENNIS TRAINING DEVICE

(a) TECHNICAL FIELD OF THE INVENTION

The present invention relates generally to the field of physical exercise and sports, and more particularly to a racket-free tennis training device.

(b) DESCRIPTION OF THE PRIOR ART

Tennis is a popular item of exercise and sports. A tennis training robot improves joyfulness and entertainment of tennis sport and also provides expertise of tennis training.

Conventional tennis training robots are generally various types of automatic tennis serving machines, which serves balls by means of electromagnetic measures, springs, or disc squeezing. Examples are Chinese Patent Application No. 201410775083.1, which discloses a tennis serving robot, and Chinese Patent Application No. 201420484892.2, which discloses a tennis hitting training device. Tennis serving robots of these kinds provide a single function of serving balls and they are incapable of simulating a real training process for tennis. In addition, the tennis serving robots of these kinds provide a monotonous way of ball serving through a fixed ball traveling path and having relatively poor accuracy and slow ball speeds. They do not provide service of complicated rotating balls and diverse ways of ball travel.

Chinese Patent Application No. 201110103967.9 discloses an automatic tennis ball serving and collecting machine, which comprises a ball collection device that involves a poker plate and a conveyor to collect balls on a tennis court and a ball serving device that conducts services of balls. This patent comprises an additional collection device, compared to the conventional single-function tennis ball serving machines, to take the place of manual collection of balls. However, such a ball connection device is designed for collecting and recovering balls on a training field and does not provide a function of training players.

SUMMARY OF THE INVENTION

To overcome such problems, the present invention provides a racket-free tennis training device that features relatively high accuracy and speed so that by using the present invention, an effect of better simulation of playing tennis with opponents of different skill levels can be achieved.

To achieve the above object, a technical solution adopted in this invention is as follows:

A racket-free tennis training device comprises a maneuverable platform, wherein the maneuverable platform comprises an elevation mechanism mounted thereon and a ball receiving and shooting mechanism is mounted on the elevation mechanism;

the ball receiving and shooting mechanism comprises a ball receiving mechanism, a ball management mechanism, a ball shooting mechanism, and a ball shooting direction control mechanism;

the ball receiving mechanism comprises a ball receptacle;

the ball management mechanism comprises a ball collection barrel and an advancing mechanism; and the ball shooting mechanism comprises a dual-disc shooting mechanism, which comprises a first disc, a second disc, a first shooting motor coupled to the first disc, and a second shooting motor coupled to the second disc, wherein the first disc and the second disc are rotatable in opposite directions and are spaced from each other by a predetermined distance, the spacing distance between the first disc and the second disc being slightly less than a diameter of a tennis ball.

Additional Arrangement Includes:

the maneuverable platform comprising a chassis, the chassis comprising direction wheels mounted thereto, the direction wheels being coupled to drive motors, the chassis also comprising an obstacle sensor mechanism mounted thereto.

The elevation mechanism comprises a guide rail mounted on the maneuverable platform. The guide rail is arranged upright on the maneuverable platform. The guide rail comprises a synchronous belt mounted thereto. The synchronous belt comprises a slide block mounted thereto. The synchronous belt and the elevation are being operatively coupled to each other. The ball receiving and shooting mechanism is coupled to the slide block.

The ball receptacle is in the form of funnel having an expanded top and a reduced bottom. The ball receptacle comprises a buffering net that is formed of an energy-absorbing material mounted thereto.

The ball collection barrel is connected to the ball receptacle. The advancing mechanism is located under the ball collection barrel. The advancing mechanism is operable to feed a bottommost one of tennis balls received in the ball collection barrel to the ball shooting mechanism.

The ball collection barrel is in the form of a cylindrical barrel having an inside diameter that is slightly greater than the diameter of the tennis ball and a height slightly greater than a height of the tennis ball.

The advancing mechanism comprises an advancing block. The advancing block is driven electromagnetically or pneumatically.

The ball receiving mechanism, the ball management mechanism, and the ball shooting mechanism are mounted in a housing. The housing comprises a shooting opening facing the ball shooting mechanism.

The ball receiving and shooting mechanism further comprises a shooting direction control mechanism. The shooting direction control mechanism comprises a drive motor mounted in the housing. A rotary shaft is mounted in the housing by a bearing. The rotary shaft has an end coupled to the drive motor and an opposite end coupled to the ball shooting mechanism.

The ball receiving and shooting mechanism further comprises a turning motor. The turning motor is coupled to the ball shooting mechanism. The turning motor is mounted on the support frame. A pitch motor is coupled to the support frame.

The racket-free tennis training device further comprises a detection mechanism. The detection mechanism is operable to detect and track a trace of a tennis ball. The detection mechanism and the maneuverable platform are integrally formed together or are arranged separate from each other.

The operation and beneficial efficacy of the present invention are as follows:

(1) Innovation and combination of a maneuverable platform, an elevation mechanism, and a ball receiving and shooting mechanism are provided for realizing tracking of a travel trace of a tennis ball, fast movement of the platform, accurate receiving of balls, ball shooting with different directions, speeds, and rotation to simulate tennis training in a racket-free manner.

The present invention provides a ball receiving mechanism, which comprises a funnel-shaped ball receptacle with a buffering net that is made of an energy-absorbing material mounted to the ball receptacle, whereby when a ball comes from the front side, the ball would get in contact with the buffering net to have the speed and kinetic energy thereof absorbed by the buffering net so that the ball will then be acted upon by the gravity to fall down to the bottom of the funnel and the ball will not get too speedy to bounce out of the funnel-shaped ball receptacle. This helps the ball receptacle to catch and trap the ball thereby reducing ball missing rate.

The present invention provides a ball management mechanism, which is composed of a ball collection barrel and an advancing mechanism. The ball collection barrel is connected to the bottom of the funnel of the ball receptacle. The advancing mechanism is operable, for each time, to push out and feed the bottommost one of the tennis balls collected in the ball collection barrel to the ball shooting mechanism.

The present invention provides a ball shooting mechanism, which comprise a turning motor and pitch motor operatively in combination with a dual-disc shooting mechanism such that the turning motor first rotates to control a rotational direction of a tennis ball. When the turning motor controls and sets the ball shooting mechanism at a horizontal position, a ball shot therefrom would be one that is a leftward or rightward rotating ball; and when the turning motor controls and sets the ball shooting mechanism at a vertical position, a ball shot therefrom would be one that is upward or downward rotating ball. At the same time, through the rotation of the pitch motor, a shooting angle of a tennis ball can be adjusted. Through a horizontal or rotational movement of the maneuverable platform, shooting can be made in any desired direction.

Thus, through the collaborative combination of the maneuverable platform, the pitch motor, and the turning motor with the dual-disc shooting mechanism, shooting in multiple directions, multiple angles, and various ways of rotation can be achieved.

(2) The present invention provides a racket-free tennis training device, which, compared with the prior art, has an expanded range and reduced ball missing rate in regard to ball receiving and has accurate control of ball serving speed with ball serving angle (horizontal and vertical directions) and the ways of rotation being accurately controllable in serving balls so as to be capable of simulating various ways of ball hitting and travel paths, making it fit to professional training purposes of tennis.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
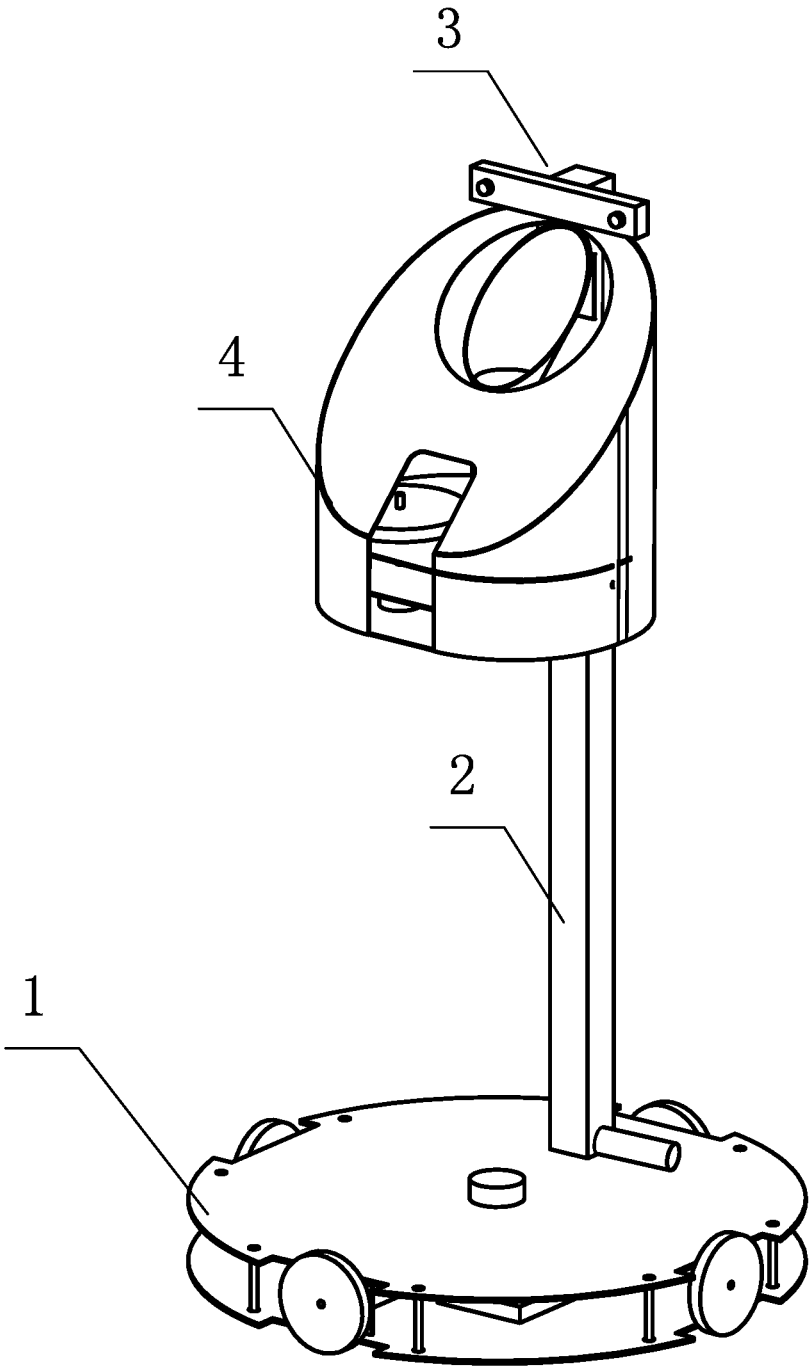
FIG. 1 is a schematic view illustrating the present invention in the entirety thereof.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 1-7, the present invention provides a racket-free tennis training device, which comprises a maneuverable platform 1, an elevation mechanism 2, a detection mechanism 3, a ball receiving and shooting mechanism 4, and a control device 5.

Figure 2:
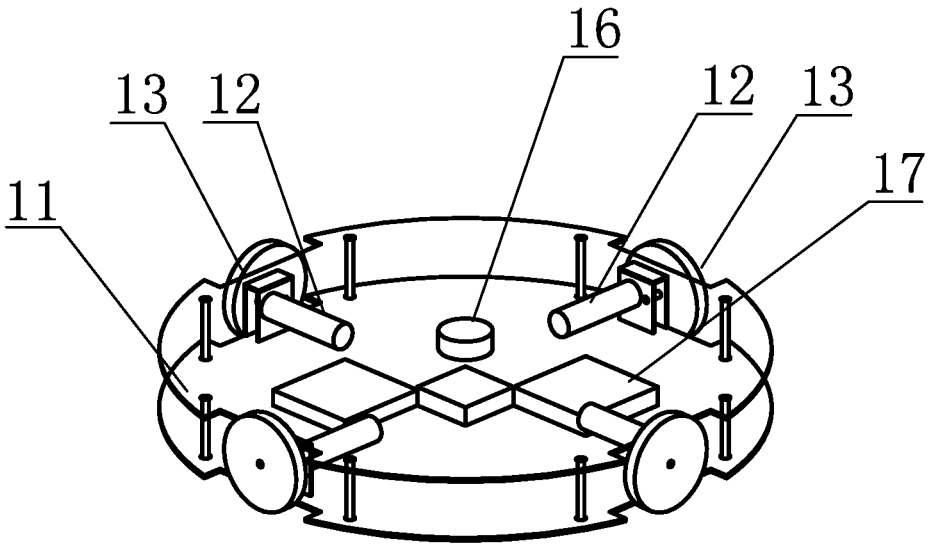
FIG. 2 is a schematic view showing a maneuverable platform of the present invention.

As shown in FIG. 2, the maneuverable platform 1 is movable on a horizontal flat surface in any direction. The maneuverable platform 1 comprises a chassis 11, and direction wheels 13 are mounted on the chassis 11. In the instant embodiment, four direction wheels 13 are provided and mounted on the chassis 11 in a uniformly arranged manner. Each of the direction wheels 13 is provided with a drive motor 12 coupled thereto. The chassis 11 also comprises an obstacle sensor mechanism 16 mounted thereon.

The number of the direction wheels 13 can be varied according to an actual application, but it is desired the number should be less than three. The direction wheels 13 can be driven individually and independently or they can be driven together in a unified or synchronous manner.

The drive motor 12 can be any type of motor, such as a direct-current reduction motor or a servomotor.

The power supply module 17 is mounted on the chassis 11 for supplying electrical power to the maneuverable platform 1 and other functional mechanisms. It is apparent that an external power source may be used to substitute or in addition to the power supply module 17.

The obstacle sensor mechanism 16 functions to detect an obstacle existing on a moving direction of the maneuverable platform 1 and controls the drive motor 12 to stop or change direction.

Figure 3:
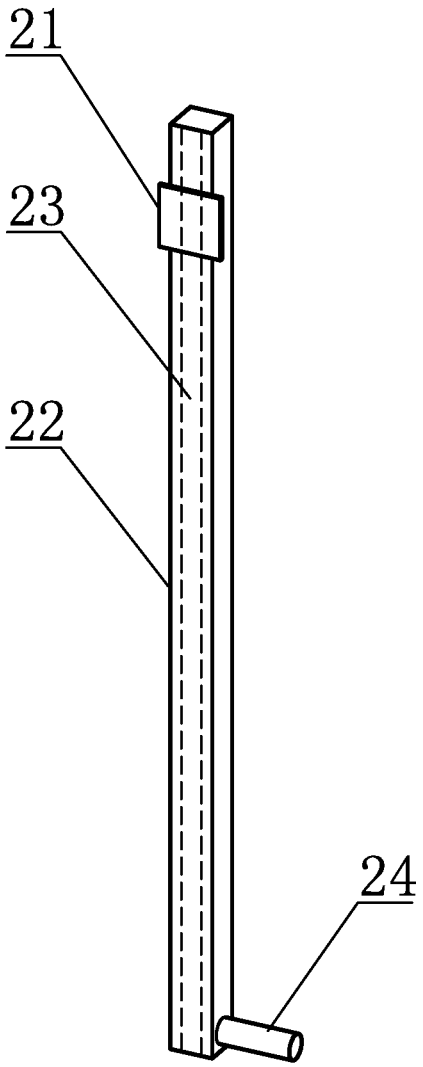
FIG. 3 is a schematic view illustrating an elevation mechanism of the present invention.

The elevation mechanism 2 can be one of for example a screw based elevation mechanism, a scissor-type elevation mechanism, a synchronous belt based elevation mechanism, and linear rail based elevation mechanism. In the instant embodiment, a synchronous belt based elevation mechanism is taken as an example. As shown in FIG. 3, the elevation mechanism 2 comprises a guide rail 22 mounted on the maneuverable platform 1. The guide rail 22 is mounted on the maneuverable platform 1 in an upright manner. The guide rail 22 comprises a synchronous belt 23 mounted thereto. The synchronous belt 23 comprises a slide block 21 mounted thereto. The synchronous belt 23 and the elevation motor 24 are operatively coupled to each other; and the ball receiving and shooting mechanism 4 is coupled to the slide block 21.

Figure 4:
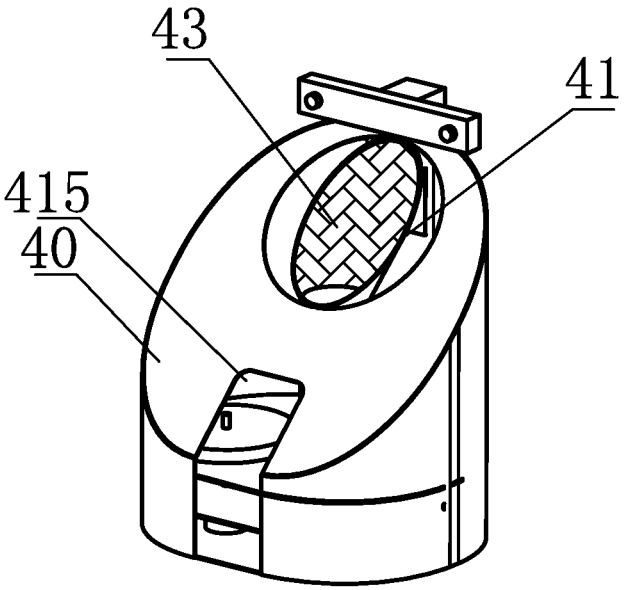
FIG. 4 is a schematic view illustrating a ball receiving and shooting mechanism of the present invention.
Figure 5:
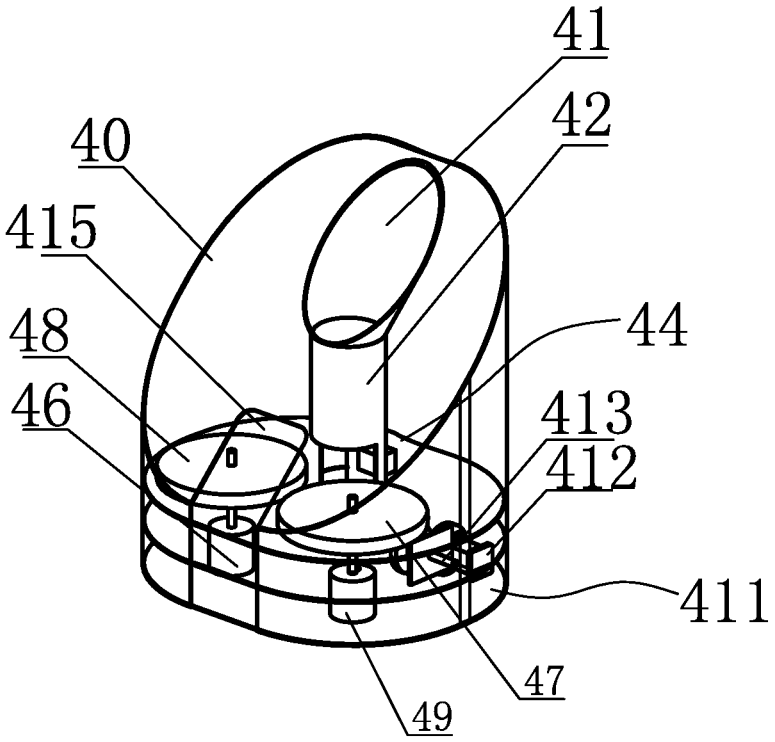
FIG. 5 is another schematic view illustrating the ball receiving and shooting mechanism of the present invention.
Figure 6:
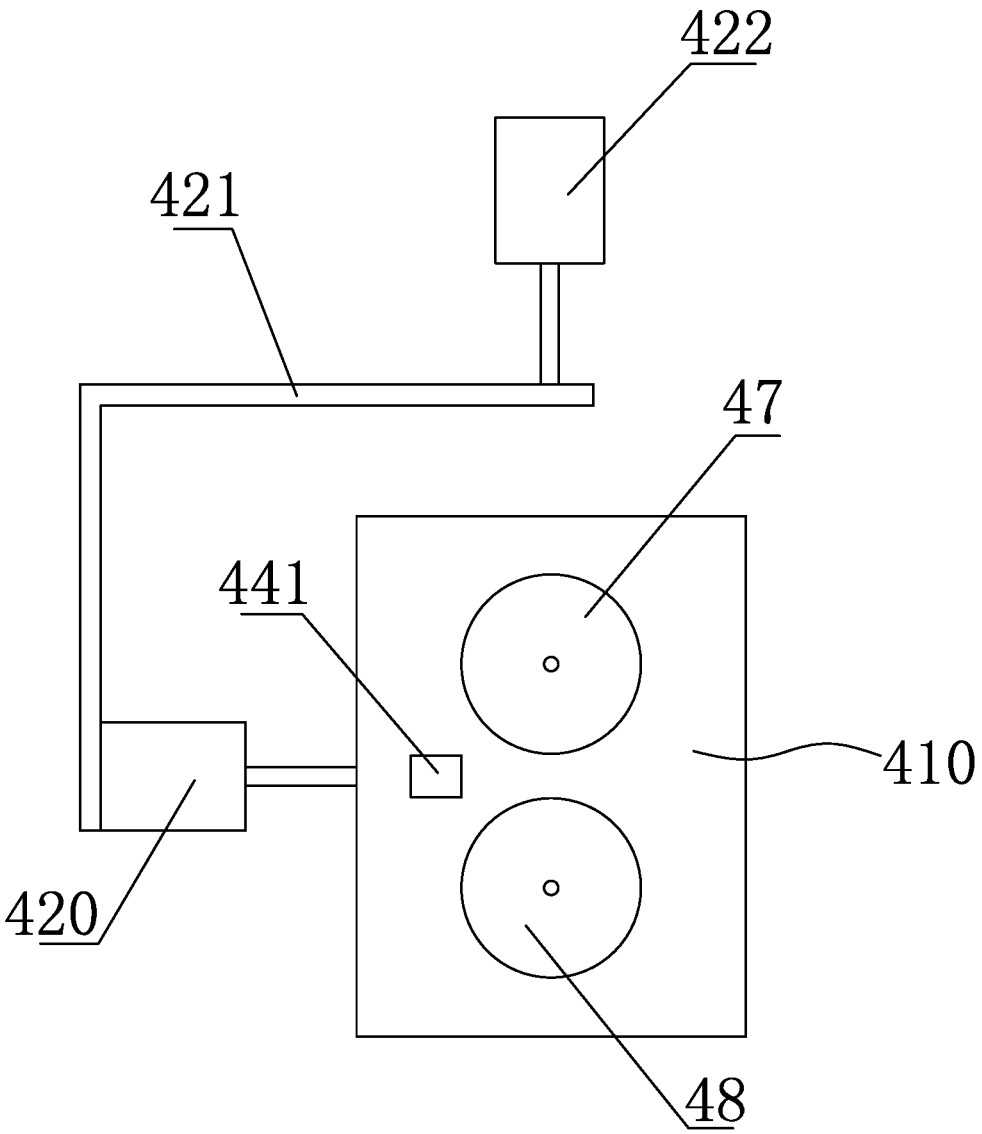
FIG. 6 is a schematic view illustrating another example of a ball receiving and shooting mechanism of the present invention.

The ball receiving and shooting mechanism 4 is specifically illustrated in FIGS. 4-6. The ball receiving and shooting mechanism 4 comprises a ball receiving mechanism, a ball management mechanism, and a ball shooting mechanism. The ball receiving mechanism comprises a ball receptacle 41. In the instant embodiment, the ball receptacle 41 is made in the form of a funnel having an expanded top and a reduced bottom. As a preferred embodiment, the ball receptacle 41 comprises a buffering net 43 that is made of an energy-absorbing material mounted thereto in order to prevent a ball from bouncing out of the ball receptacle 41 due to the speed thereof. The ball management mechanism comprises a ball collection barrel 42 and an advancing mechanism 44. The ball collection barrel 42 is connected to the ball receptacle 41. The ball collection barrel 42 is preferably in the form of a cylindrical barrel, of which an inside diameter is slightly greater than a diameter of a tennis ball and a height that is greater than at least one tennis ball. The advancing mechanism 44 is located under the ball collection barrel 42 and comprises an advancing block 441. The advancing block 441 is driven in an electromagnetic or pneumatic measure.

The ball shooting mechanism 410 is a dual-disc shooting mechanism, which comprises a first disc 48, a second disc 47, a first shooting motor 46 that is coupled to the first disc 48, and a second shooting motor 49 that is coupled to the second disc 47. The first disc 48 and the second disc 47 are arranged to rotate in opposite directions and are spaced from each other by a predetermined distance. The spacing distance between the first disc 48 and the second disc 47 is slightly less than the diameter of a tennis ball so that a tennis ball that falls down can be received by and pinched between the first disc 48 and the second disc 47. Through control of rotational speeds of the first disc 48 and the second disc 47, control of the speed and rotational direction of the ball can be achieved. When the two discs are rotated in opposite directions at the same speed, a ball shot or served is one that does not rotate; and when one of the first disc 48 and the second disc 47 is rotated at a higher speed, a ball shot or served is one that rotated leftward or rightward.

As a preferred option, the ball receiving mechanism, the ball management mechanism, and the ball shooting mechanism are arranged inside and mounted in a housing 40. The housing 40 is provided with a shooting opening 415 facing the ball shooting mechanism.

The ball receiving and shooting mechanism 4 also comprises a shooting direction control mechanism 411. The shooting direction control mechanism 411 comprises a drive motor 412 that is mounted in the housing 40. A rotary shaft 413 is mounted in the housing 40 by means of a bearing. The rotary shaft 413 has an end coupled to the drive motor 412 and an opposite end coupled to the ball shooting mechanism. Under the action of the drive motor 412, the rotary shaft 413 is rotated to drive the ball shooting mechanism to rotate with respect to the housing 40. By means of the shooting direction control mechanism 411, a shooting direction of a tennis ball can be adjusted (adjustment of pitch) to provide diverse ways of traveling path of the ball.

FIG. 6 illustrates another example, which allows for diverse ways of shooting directions and various ways of rotation of a ball shot therefrom, wherein the ball receiving and shooting mechanism 4 is additionally provided with a turning motor 420 and the turning motor 420 is coupled to the ball shooting mechanism 410. The turning motor 420 is mounted on a support frame 421 and a pitch motor 422 is coupled to the support frame 421. With such an arrangement, the turning motor 420 first rotates to control the rotational direction of a tennis ball. When the turning motor 420 controls and sets the ball shooting mechanism 410 on a horizontal position, adjusting the rotational speeds of the first disc 48 and the second disc 47 would make it possible to shoot or serve a leftward or rightward rotating ball; and when the turning motor 420 controls and sets the ball shooting mechanism 410 on a vertical position, adjusting the rotational speeds of the first disc 48 and the second disc 47 would make it possible to shoot or serve an upward or downward rotating ball. Meanwhile, through the rotation of the pitch motor 422, an end of the support frame 421 that is coupled to the pitch motor 422 is driven to move upward or downward and this allows for adjustment of a shooting angle of a tennis ball. Through horizontal movement or rotational movement of the maneuverable platform 1, shooting can be made in any desired direction.

Thus, the maneuverable platform 1, the pitch motor 422, and the turning motor 420 help achieve shooting of ball at multiple directions, multiple angles, and various ways of rotation.

The detection mechanism 3 can be integrally formed with the maneuverable platform 1, or can alternatively be arranged separate from the maneuverable platform 1. The detection mechanism 3 functions to detect and track a trace of a ball. The detection mechanism 3 can be a known video detection mechanism or other types of detection mechanism, such as binocular stereoscopic image pickup head or a RGB-D image pickup head. Image collected with the detection mechanism 3, such as trace, velocity, and falling point of a tennis ball, is transmitted to the control device 5 for data processing, and then, control and drive of the maneuverable platform 1, the elevation mechanism 2, and the ball receiving and shooting mechanism 4 can be performed for accomplishing desired operations.

The control device 5 is connected to the detection mechanism 3, the elevation mechanism 2, the maneuverable platform 1, and the ball receiving and shooting mechanism 4.

Figure 7:
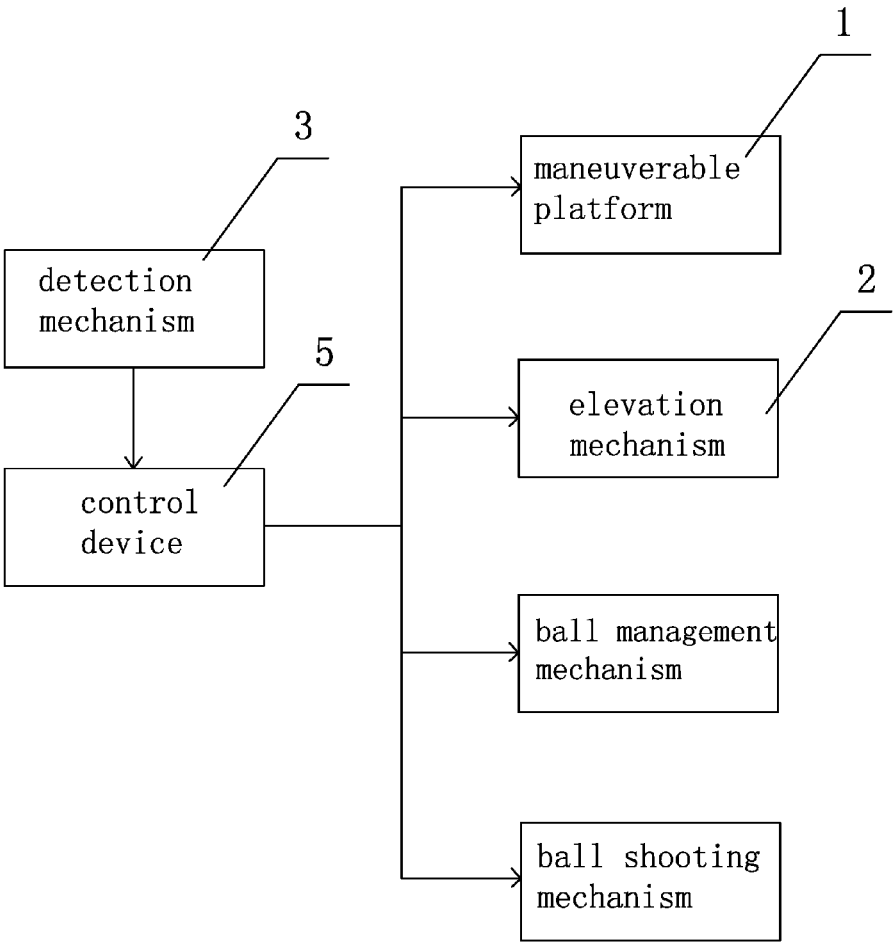
FIG. 7 is a block diagram illustrating control principle of the present invention.

An operation of the present invention will be discussed with reference to FIG. 7:

Firstly, the racket-free tennis training device according to the present invention is positioned at a central portion of a work field to allow the detection mechanism 3 to detect images of objects located in the proximity to conduct an initial positioning. The ball receiving and shooting mechanism 4 is moved to a middle vertical position along the elevation mechanism 2. A plurality of tennis balls is positioned in the ball collection barrel 42 of the ball management mechanism to allow the advancing mechanism 44 to push and advance, for each time, a ball located exactly in front thereof into the dual-disc shooting mechanism so as to complete initialization of the system.

After the initialization, a working state is started and the detection mechanism 3 monitoring any ball coming toward the machine, tracking the trace and falling point of a ball from the opponent site, which are used in combination with the location of itself to automatically conduct receiving of the coining ball directly or to receive the ball after the ball falls down to the ground and gets bounced. Such information is transmitted to the control device 5, so that the control device 5 may drive the maneuverable platform 1 toward the best location for ball receiving and at the same time, the elevation mechanism 2 adjusts the height or vertical location of the ball receiving mechanism to allow the tennis ball to accurately fall into the funnel-shaped ball receptacle 41 of the receiving mechanism and further fall down into the ball collection barrel 42. At the same time when the tennis ball is received, the turning motor 420 controls and sets the ball shooting mechanism to a desired position (such as a vertical position or a horizontal position) and the pitch motor 422 adjusts the elevation angle of the ball shooting mechanism to a desired angular position. Afterwards, the shooting motor of the dual-disc shooting mechanism starts to operate to drive the two discs to rotate at desired fashion and desired rotational speeds. The tennis balls received in the ball collection barrel 42 is pushed and advanced by the advancing mechanism 44 such that for each time, one ball is fed into the spacing gap between the two discs, allowing the two discs to squeeze and shoot out the ball for simulating hitting a ball with a racket. This completes one cycle of ball receiving and shooting.

After the ball is shot, the racket-free ball receiving and shooting device returns to the initial position in the work field and the above process is repeated.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

We claim:

1. A racket-free tennis training device, comprising a maneuverable platform, wherein the maneuverable platform comprises an elevation mechanism mounted thereon and a ball receiving and shooting mechanism is mounted on the elevation mechanism;

the ball receiving and shooting mechanism comprising a ball receiving mechanism, a ball management mechanism, and a ball shooting mechanism;

the ball receiving mechanism comprising a ball receptacle;

the ball management mechanism comprising a ball collection barrel and an advancing mechanism;

the ball shooting mechanism comprising a dual-disc shooting mechanism, which comprises a first disc, a second disc, a first shooting motor coupled to the first disc, and a second shooting motor coupled to the second disc, wherein the first disc and the second disc are rotatable in opposite directions and are spaced from each other by a predetermined distance, the spacing distance between the first disc and the second disc being slightly less than a diameter of a tennis ball;

wherein the maneuverable platform comprises a chassis, the chassis comprising direction wheels mounted thereto, the direction wheels being coupled to drive motors, the chassis also comprising an obstacle sensor mechanism mounted thereto.

2. The racket-free tennis training device according to claim 1, wherein the elevation mechanism comprises a guide rail mounted on the maneuverable platform, the guide rail being arranged upright on the maneuverable platform, the guide rail comprising a synchronous belt mounted thereto, the synchronous belt comprising a slide block mounted thereto, the synchronous belt and the elevation motor being operatively coupled to each other, the ball receiving and shooting mechanism being coupled to the slide block.

3. The racket-free tennis training device according to claim 1, wherein the ball receptacle is in the form of funnel having an expanded top and a reduced bottom, the ball receptacle comprising a buffering net that is formed of an energy-absorbing material mounted thereto.

4. The racket-free tennis training device according to claim 1, wherein the ball collection barrel is connected to the ball receptacle, the advancing mechanism being located under the ball collection barrel, the advancing mechanism being operable to feed a bottommost one of tennis balls received in the ball collection barrel to the ball shooting mechanism.

5. The racket-free tennis training device according to claim 4, wherein the ball collection barrel is in the form of a cylindrical barrel having an inside diameter that is slightly greater than the diameter of the tennis ball and a height slightly greater than a height of the tennis ball.

6. The racket-free tennis training device according to claim 4, wherein the advancing mechanism comprises an advancing block, the advancing block being driven electromagnetically or pneumatically.

7. The racket-free tennis training device according to claim 1, wherein the ball receiving mechanism, the ball management mechanism, and the ball shooting mechanism are mounted in a housing, the housing comprising a shooting opening facing the ball shooting mechanism; and the ball receiving and shooting mechanism further comprises a shooting direction control mechanism, the shooting direction control mechanism comprising a drive motor mounted in the housing, a rotary shaft being mounted in the housing by a bearing, the rotary shaft having an end coupled to the drive motor and an opposite end coupled to the ball shooting mechanism.

8. The racket-free tennis training device according to claim 1, wherein the ball receiving and shooting mechanism further comprises a turning motor, the turning motor being coupled to the ball shooting mechanism, the turning motor being mounted on a support frame, a pitch motor being coupled to the support frame.

9. The racket-free tennis training device according to claim 1, wherein the racket-free tennis training device further comprises a detection mechanism, the detection mechanism being operable to detect and track a trace of a tennis ball, the detection mechanism and the maneuverable platform being integrally formed together or being arranged separate from each other.

* * * * *